United States Patent [19]

Ito

[11] Patent Number: 4,755,851

[45] Date of Patent: Jul. 5, 1988

[54] MAGNIFICATION-VARIABLE COPIER

[75] Inventor: Masazumi Ito, Toyohashi, Japan

[73] Assignee: Minolta Camera Kabushiki Kaisha, Osaka, Japan

[21] Appl. No.: 95,580

[22] Filed: Sep. 10, 1987

[30] Foreign Application Priority Data

Sep. 12, 1986 [JP] Japan ..... 61-216792

[51] Int. Cl.[4] ..... G03G 15/00

[52] U.S. Cl. ..... 355/14 R; 355/14 C; 355/55

[58] Field of Search ..... 355/14 R, 55, 60, 3 R, 355/14 C, 56

[56] References Cited

U.S. PATENT DOCUMENTS

| | | | |
|---|---|---|---|
| 4,505,579 | 3/1985 | Furuichi | 355/55 |
| 4,619,521 | 10/1986 | Miyamoto | 355/14 R |
| 4,644,499 | 2/1987 | Shibazaki et al. | 355/55 X |
| 4,657,380 | 4/1987 | Hamano et al. | 355/55 |
| 4,669,858 | 6/1987 | Ito et al. | 355/14 R |
| 4,697,917 | 10/1987 | Takano et al. | 355/14 R |
| 4,714,944 | 12/1987 | Yoshiura | 355/14 R |

*Primary Examiner*—R. L. Moses

*Attorney, Agent, or Firm*—Price, Gess & Ubell

[57] ABSTRACT

A copier having a magnification setting mechanism equipped with an improved numeral calculating function. According to the copier, immediately after a completion of magnification calculation and based on a calculated result, a magnification setting is carried out, thereby enabling a copying operation and also the calculated result is stored in a memory when necessary.

5 Claims, 17 Drawing Sheets

MAGNIFICATION-VARIABLE COPIER

BACKGROUND OF THE INVENTION

In recent years, there have been provided copiers capable of successively varying a copy magnification. The applicant of the present invention also suggested and filed such copier on July 13, 1984, with a Ser. No. 630,729, which magnification input means is linked with a numeral calculator function. In operation, according to a divisor function as an example of this numeral calculator function, a length of copy paper and a length of document are respectively input by means of ten keys and the former is divided by the latter to provide a disired magnification. This feature is particularly convenient in case the copy paper and/or the document are not of the standard size. However, according to the contents disclosed in the above application, a copying becomes possible with activation of magnification setting mechanism such as lens movement only after writing a calculated result into a memory by operating a predetermined key after the calculation. It is to be noted here that the memory comprises a non-volatile memory capable, by the operation of the predetermined key, of always reading out the calculated result as a desired magnification. Therefore, if the magnification obtained by the calculation is to be used repeatedly, the above construction is convenient.

However, in many cases, the magnification, which has to be obtained by a calculation, is used only temporarily, and it is inefficient and troublesome to write the calculated result into a memory by operating the key each time a different magnification is to be set.

SUMMARY OF THE INVENTION

Accordingly, it is one object of the present invention to provide a copier having a magnification setting mechanism equipped with an improved numeral calculating function.

It is another object of the present invention to provide the above copier with a feature giving a user an option about whether or not to store the magnification obtained by the calculating function into the memory depending on the frequency of using this magnification.

These and other objects of the present invention are accomplished by a magnification-variable copier in which a magnification setting is carried out, thereby enabling a copying operation, based on the calculated result immediately after the completion of magnification calculation and in which the calculated result is stored in a memory when necessary. In the case of this copier, although a settable magnification range is limited because of the construction of the copier, the calculating function per se is not limited by the settable magnification range. In the case of the present invention, since the magnification setting is carried out without any special operations, if the calculated result does not belong in the settable magnification range, the magnification setting operation is carried out after adjusting the calculated result into the range.

BRIEF DESCRIPTION OF THE DRAWINGS

Accompanying drawings illustrate preferred embodiments of a magnification-variable copier related to the present invention; in which.

DESCRIPTION OF PREFERRED EMBODIMENTS

Firstly, a construction of copier related to the present invention will be particularly described.

Figure 1:
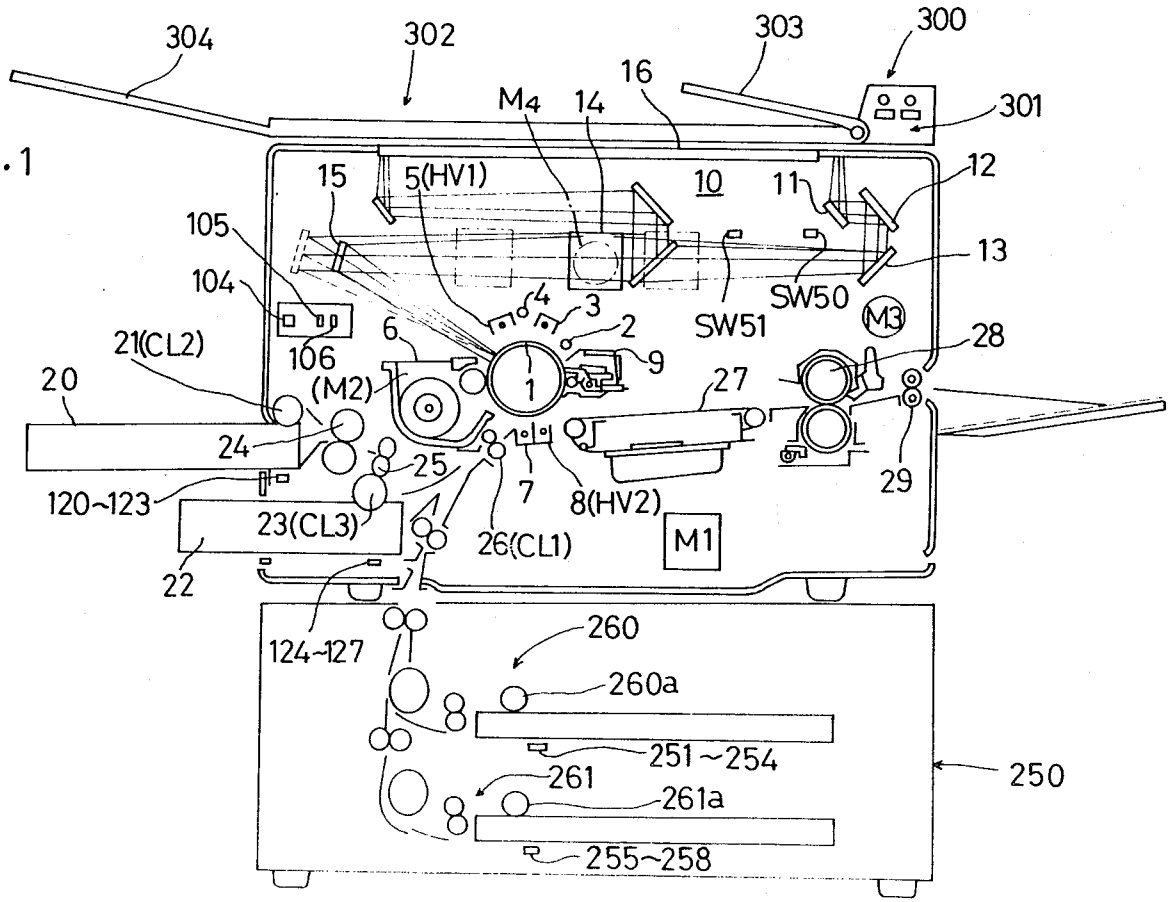
FIG. 1 is a view showing a construction of the copier related to the present invention.

FIG. 1 is a view showing the construction of the copier related to the present invention.

The copier comprises substantially centrally thereof a photosensitive drum 1 rotatable counterclockwise, about which there are provided a main eraser lamp 2, an auxiliary electro static charger 3, an auxiliary eraser lamp 4, a main electro static charger 5, a developing device 6, a transfer charger 7, a copy-paper separater charger 8 and a blade type cleaning 9. The photosensitive drum has its surface lined with a photosensitive layer and undergoes intensifying electrification by passing the eraser lamps 2, 4 and the electro static chargers 3, 5 and undergoes image exposure by an optical unit 10.

This optical unit 10 is disposed in such a way as to permit an original image to be scanned beneath a document holder glass 16, the optical unit 10 including a light source not shown, movable mirrors 11, 12, 13, a lens 14 and a mirror 15. The movable mirror 11 moves leftwardly at a speed v/m (m: copy magnification) for a peripheral speed 'v', which is fixed regardless of magnification, of the photosensitive drum 1; whereas, the movable mirrors 12, 13 move also leftwardly at a speed v/2m, the mirrors 11, 12, 13 all being moved by a DC motor M3. For varying copy magnification, in addition to the above mirror movements, the lens 14 shifts on an optical path and the other mirror 15 moves and pivots.

Leftwardly of the copier body, there are provided paper supply sections 20, 22 respectively having paper supply rollers 21, 23. The copy paper conveyer route includes a pair of rollers 24, 25, a timing roller 26, a conveyer belt 27, a fixing device 28 and a discharge roller 29.

Referring to the copier body, reference numerals 120 through 123, 124 through 127, 251 through 254 and numerals 255 through 258 respectively denote paper code (size) detector switches for paper supply sections A, B, C and D in a paper supply stand 250.

Referring further to FIG. 1, reference numerals 300 and 301 denote automatic paper selector switches and displays of an automatic document feeder 302 (to be briefly referred to as ADF hereinafter). The ADF 302 is mounted on a document table 16 and a document is inserted downwardly from a tray section 304 to be stopped at a predetermined position on the document table 16. After a copying has been finished, the document is turned over and discharged onto a tray 303. The copier and the ADF are coupled with each other so that the copier is not started while the document is being transported or at least the document is not transported while the copier is scanning the document.

The paper supply stand 250 serves also as a mount stand for the copier and incorporates therein paper supply mechanisms 260, 261 and paper supply rollers 260a, 261a, the latter being selectively driven in response to a signal generated from a microcomputer provided in the copier body. In this operation, this paper supply start signal must be generated at a timing earlier than a signal for the paper supply rollers.

Figure 2:
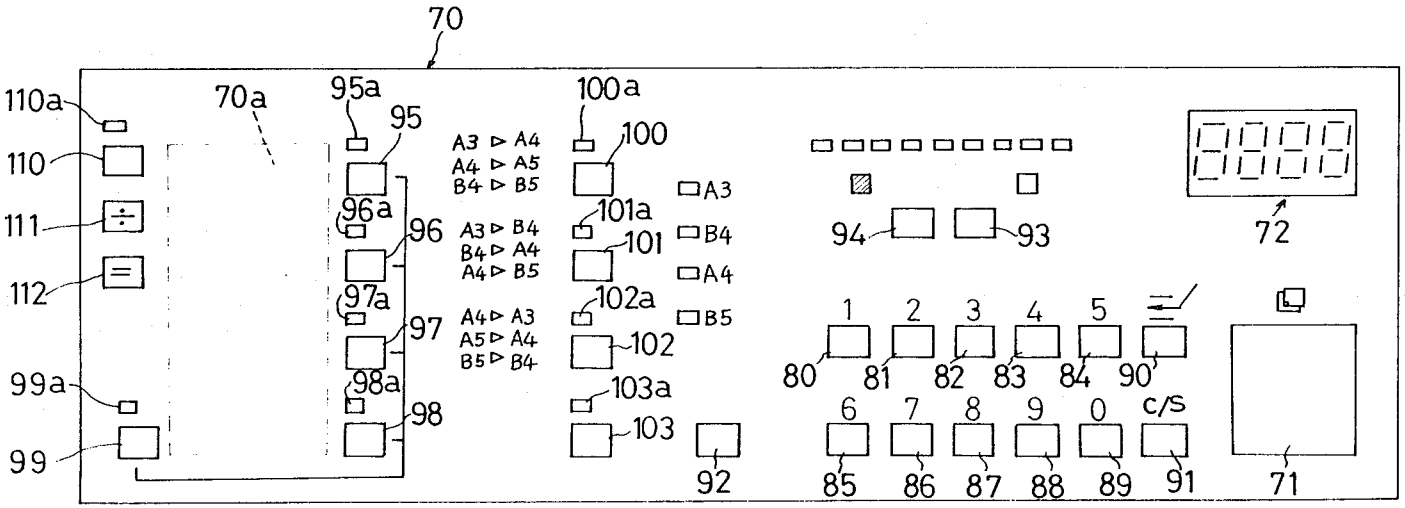
FIG. 2 is a plane view showing a control panel of the copier.

FIG. 2 illustrates a control panel section of the copier.

This control panel 70 carries a print key 71 for starting copying, a number display device 72 capable of displaying four digit numerical values, ten keys 80 through 89 respectively corresponding to numerals 1, 2, . . . 9, 0, an interruption key 90 for setting an interruption copying, a clear-stop key 91, a paper select key 92 for designating a particular size of copy paper among various sizes of copy papers disposed in plurality of layers, an UP key and Down key 93, 94 for varying and designating stepwise a copy image density and a group of keys 95 through 103 coupled with a magnification setting device.

Among the group of keys 95 through 103, a first group of magnification setting keys 95, 96, 97, 98 are adapted for manually setting a particular copy magnification. More specifically, when a control mode of the copier is switched to a first magnification setting mode with an operation of the key 99 adapted for switching to the first magnification setting mode (a manual magnification setting mode) and if any of this group of keys 95, 96, 97, 98 is operated, a value having been input by means of the ten keys and currently being displayed on the display device 72 is stored in a memory area reserved for that particular operated key. A reference mark 99*a* denotes a display lamp for displaying that the manual magnification setting mode has been set.

In the case of a second group of magnification setting keys 100, 101, 102, 103, predetermined magnifications are stored in memory areas respectively reserved for these keys. Therefore, unlike the first group of keys which necessitate a manual magnification setting, a copying may be automatically carried out based on a preset value. These preset values are selected when the copier is shipped from factory to a user in such a way that the preset values may include magnifications to be frequently used by this particular user. The selection of these preset values will be more particularly described later.

However, since these preset values respectively set for the above second group of keys are decided by mere computation, because of possible mechanical or design tolerance, there sometimes occur cases when an actually obtained copy has a magnification slightly different from the intended magnification. For instance, when the intended magnification is 100% (×1), the actually obtained copy may have a magnification of (×1.004) or of (×0.996).

In order to solve this problem, there is provided another key 104. By switching the control mode of the copier from the first magnification setting mode to the second magnification setting mode with an operation of this key 104 disposed inside the copier body and by setting a desired value in the memory areas respectively corresponding to the keys 100 through 103 in the same manner as in the case of the first magnification setting mode, it is possible to obtain the precise desired copy magnification. For instance, by setting a value 1.002 or 0.998 for the key for 100% magnification, the mechanical or design tolerance may be adjusted.

A reference numeral 110 denotes a calculator mode key. With an operation of this calculator mode key 110, a calculator mode for calculating a copy magnification is set. After this mode is set, a size of copy paper, which is a dividend, is input by means of the ten keys. A reference mark 110*a* denotes a display lamp which illuminates with a depression of the caluculator mode key 110 to show that the control mode of the copier is now in the caluculator mode.

A reference numeral 111 denotes a division key. As described above, after the size of copy paper is input by means of the ten keys 80 through 89 and then if this division key 111 is depressed, the input value is stored as dividend data in a predetermined memory area. After the depression of the division key 111, a size of the copy paper, which is a divisor, is input by means of the ten keys.

A reference numeral 112 denotes an equal key. With a depression of this eqal key 112, the dividend value is divided by the divisor value, which result is shown on the number display device 72. Further, almost concurrently therewith, based on this result, the lens 14 and the mirror 15 are driven and the optical unit is set so as to permit copying of the calculated magnification. If the calculated value does not exist within a predetermined range (0.647–1.414), an upper or lower limit adjustment is made with a caluculated value under 0.647 being adjusted to 0.647 and with a calculated value over 1.414 being adjusted to 1.414, whereby the display unit and the optical unit are set. Further, if any of the magnification setting keys 95 through 98 is depressed thereafter, the calculated value (the value having underone the upper and lower limit adjustment) is stored in a memory area corresponding to said depressed key.

Figure 3:
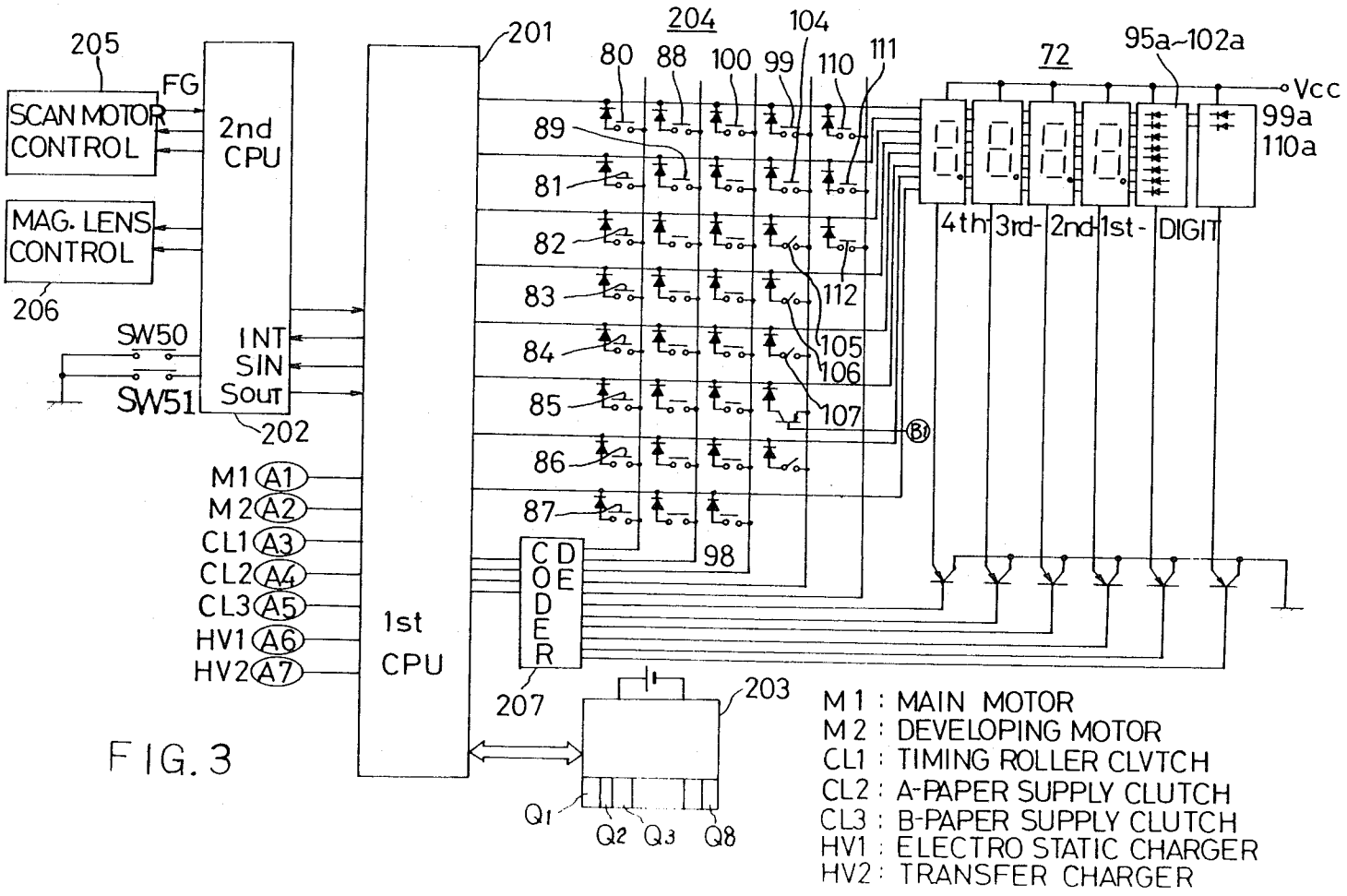
FIG. 3 is a diagram of an electronic circuit of the copier.

FIG. 3 is a control circuit diagram of the copier related to the present invention.

Referring to reference numerals and marks in the same figure, 202 stands for a second CPU for controlling the optical unit coupled through an interruption terminal INT, a data input terminal Sin and a data output terminal Sout with a first CPU for controlling main functions of the copier, 203 for a RAM backed-up by a battery, 204 for a switch matrix, 205 for a drive circuit for a direct current motor M3 for scanning a document, 206 for a drive circuit for a stepping motor M4 for setting a magnification and 207 for a decoder, respectively. Output terminals A1 through A7 are connected to drive switching transistors (not shown) respectively for a main motor M1, a developing motor M2, a timing roller clutch CL1, an upper paper supply clutch CL2, a lower paper supply clutch CL3, the main electro static charger 5 and for the transfer charger 7.

Various data for controlling copying operations are written into or shifted from a ROM in the CPU and stored in the RAM 203, in which there are provided the memory areas Q1 through Q4 corresponding to the select keys 100 through 103. Accordingly, as will be described more particularly later, if the select key 100 is operated, a value on the display device 72 is written into or read out from the memory area Q1 as the copy magnification. On the other hand, if the select key 101 is operated, the value is written into or read out from the memory area Q2. The other select keys 95 through 98 and the memory areas Q5 through Q8 are coupled with each other in the same way as described above. For another instance, if the select key 95 is operated, the magnification is written into or read out from the memory area Q5.

Nextly, functions of the copier of the above embodiment will be particularly described.

FIGS. 4 through 12 are flow charts illustrating processing for controlling the magnification settings and copying operations carried out at the first CPU 201.

Figure 4:
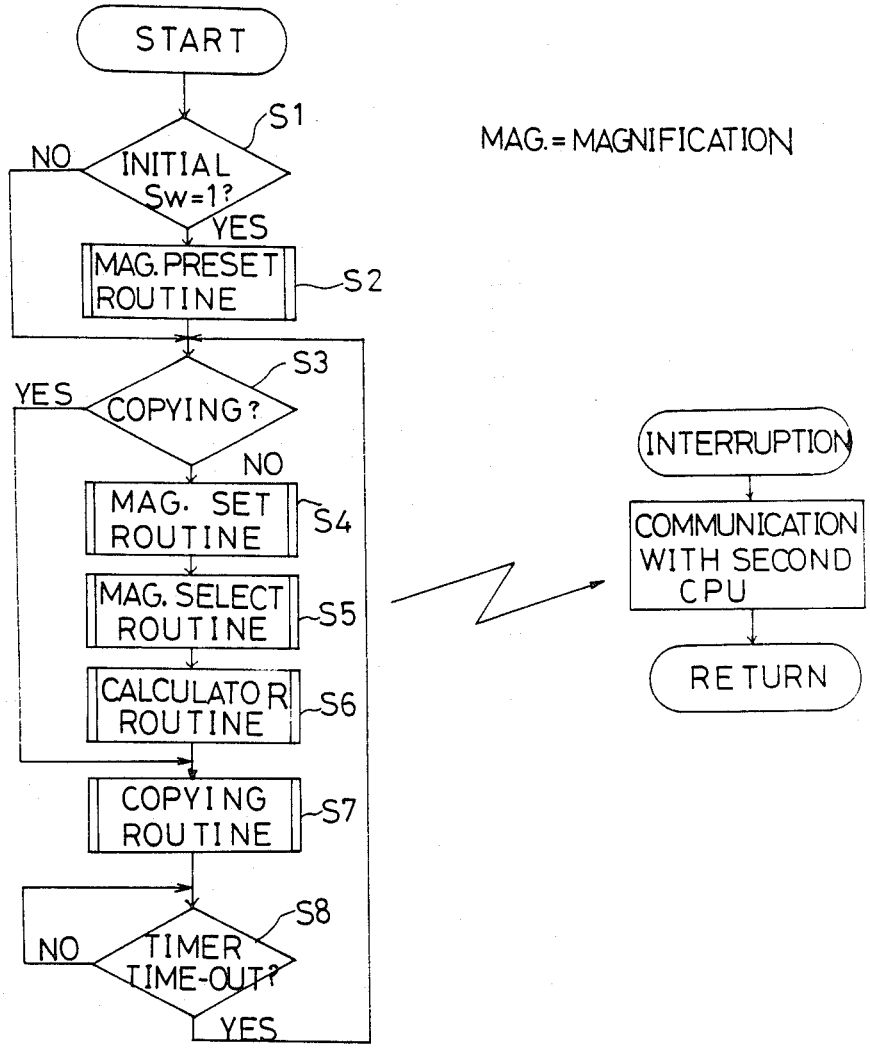
FIGS. 4 through 12 are flow charts illustrating operations executed at a first CPU, with FIG. 4 being an overall schematic flow chart, FIG. 5 illustrating particularly a step S2 in FIG. 4, FIGS. 6 through 8 particularly showing a step S4 in FIG. 4, FIGS. 9 and 10 particularly illustrating a step S5 in FIG. 4, FIGS. 11A and 11B particularly illustrating a step S6 in FIG. 4, and FIGS. 12A and 12B particularly illustrating a step S7 in FIG. 4.

FIG. 4 is a flow chart schematically and generally illustrating the processing steps at the first CPU 201. The first CPU 201 and the second CPU 202 communicate with each other through interruptions. That is to say, such information as a scanning instruction for the optical unit, a scanning size, a copy magnification, a timing signal, a return signal, a positional parameter signal and the like are communicated between these CPUs.

At steps S1, S2, the presetting operations of copy magnifications at the memory areas Q1 through Q4 at the time of copier assembly and shipping from the factory are effected, which operations will be particularly described with reference to FIG. 5.

At step S4, provided that the copier is not currently operated, magnification setting operations are carried out, with the keys 95 through 98 or the keys 100 through 103 being coupled with the respective memory areas Q5 through Q8 or Q1 through Q4, which operations will be particularly described with reference to FIGS. 6 through 8.

At step S5, also provided that the copier is not currently operated, the magnification data set at step S4 is read out and then transferred to the second CPU 202. This data transfer is processed by an interruption at the second CPU 202. This step S5 will be more particularly described with reference to FIGS. 9 and 10.

At step S6, in the same way as at the above steps S4 and S5, provided that the copier is not currently operated, the calculating operation of magnification under the calculator mode is carried out, which operation will be more particularly described with reference to FIGS. 11A and 11B.

At step S7, various operations for controlling copying are carried out, which operations will be more particularly described with reference to FIGS. 12A and 12B and which functions are shown in a timing chart of FIG. 13.

Figure 5:
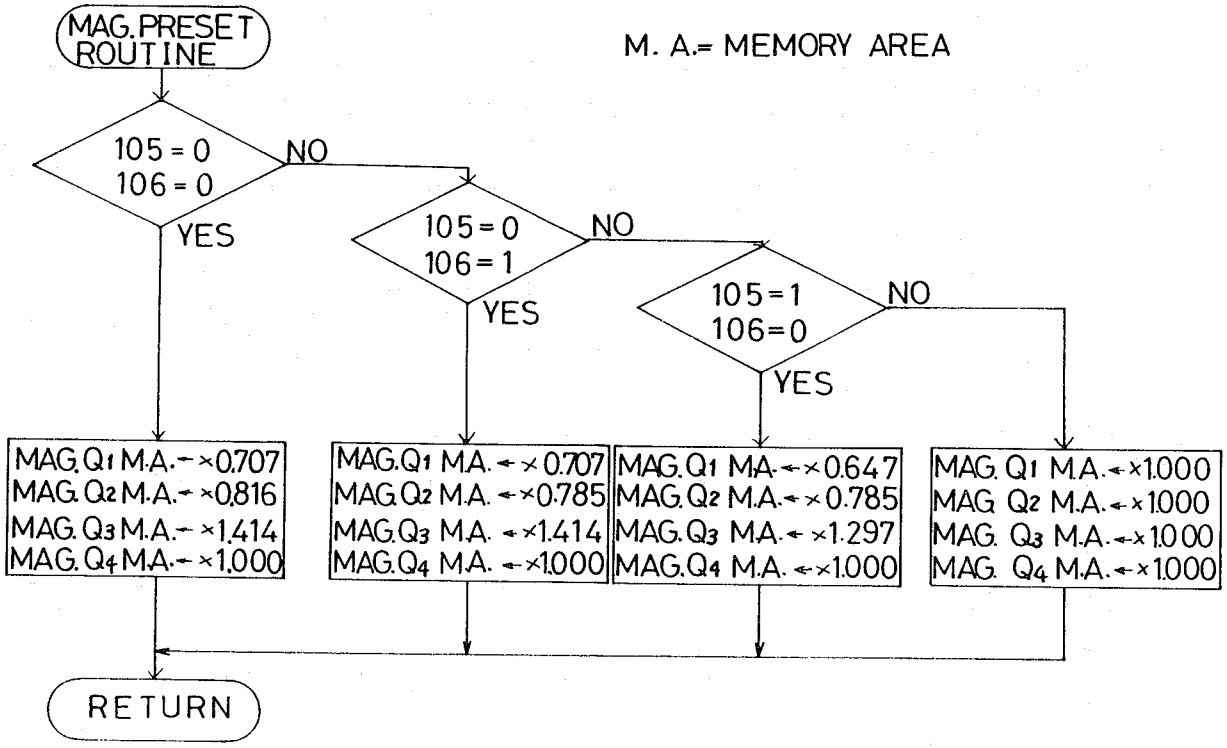

FIG. 5 is a flow chart specifically illustrating the initial setting operations for presetting predetermined magnification data at the momory areas Q1 through Q4 set at the RAM 203 in accordance with the group of keys 100 through 103 for the second magnification setting.

Referring to the same figure, what is denoted by an initial switch is a switch disposed at a normally inaccessible place inside the copier body, the switch being operable only, for example, at the time of copier assembly at the factory or by a service person. When this initial switch is operated, the processes shown in FIG. 5 are carried out.

The values to be present at the memory areas Q1 through Q4 are determined by a combination of operations of the keys 105, 106 (disposed inside the copier body). More particularly, at the time of copier assembly or shipping from the factory, depending on predetermined combinations desired by the particular user, an operator operates these switches 105, 106 to turn 'ON' or 'OFF' and thereafter turn 'OFF' the initial switch, whereby the specific magnification data are written into the memory areas Q1 through Q4.

Figure 7A:
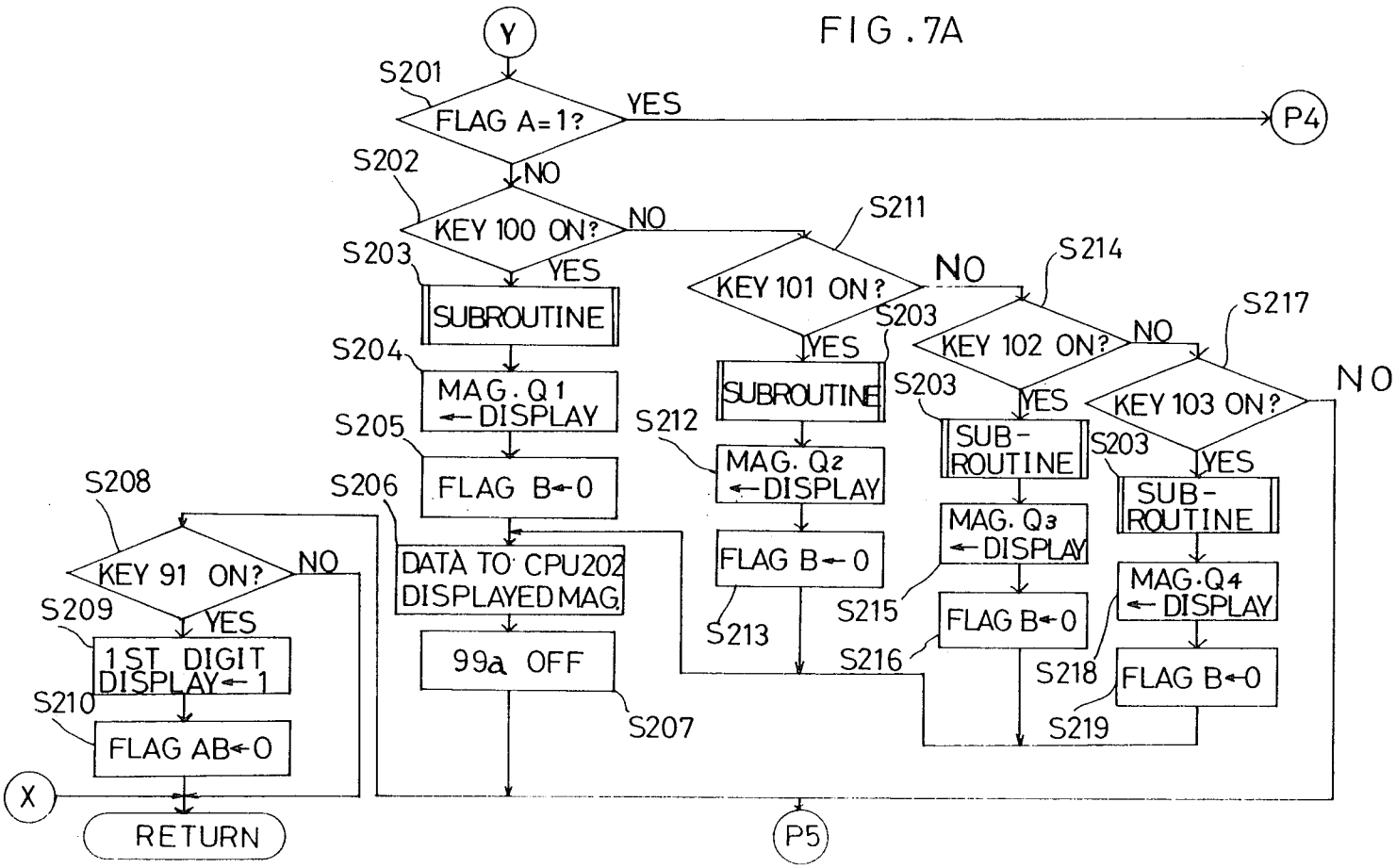
Figure 7B:
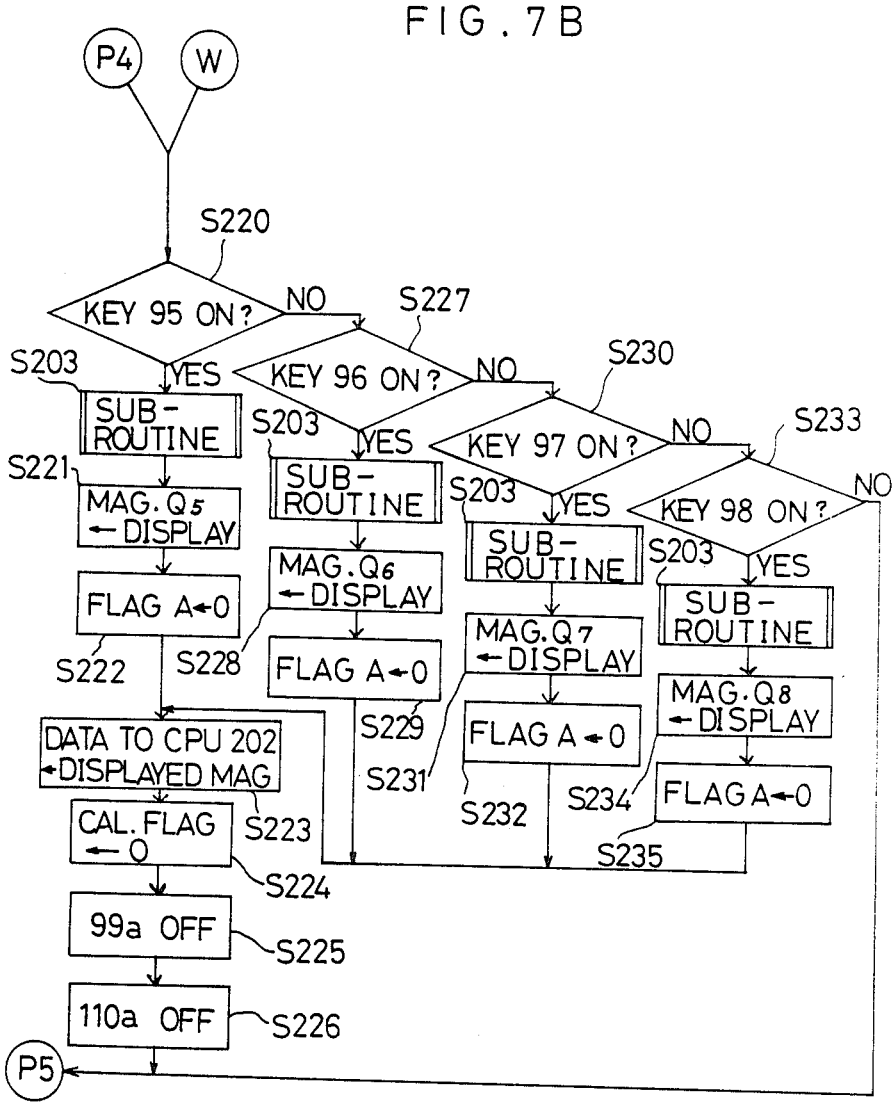
Figure 8:
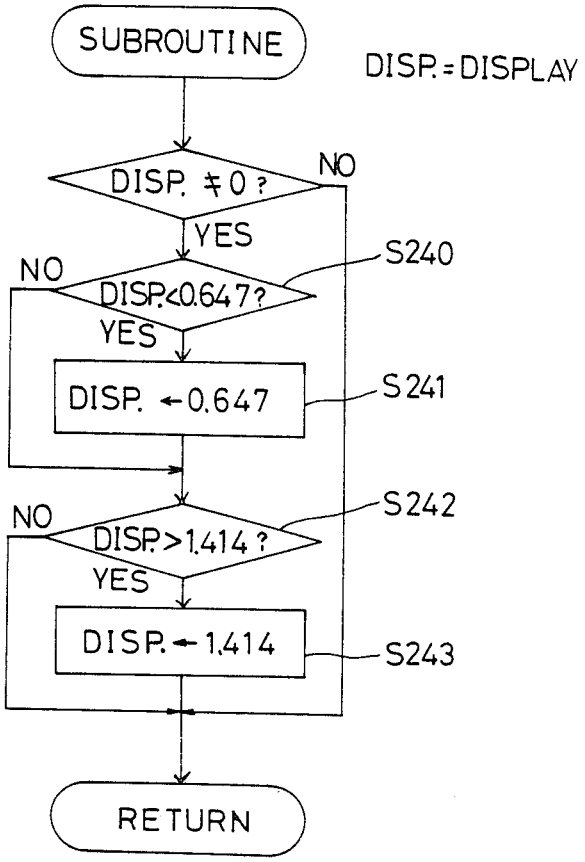

FIGS. 6 through 8 are a flow chart illustrating processes in which numerical values as magnifications are adjusted (when needed) and set at the momory areas Q1 through Q4 and Q5 through Q8 respectively corresponding to the select keys 100 through 103 and 95 through 98 and then are transferred to the second CPU 202.

Figure 6A:
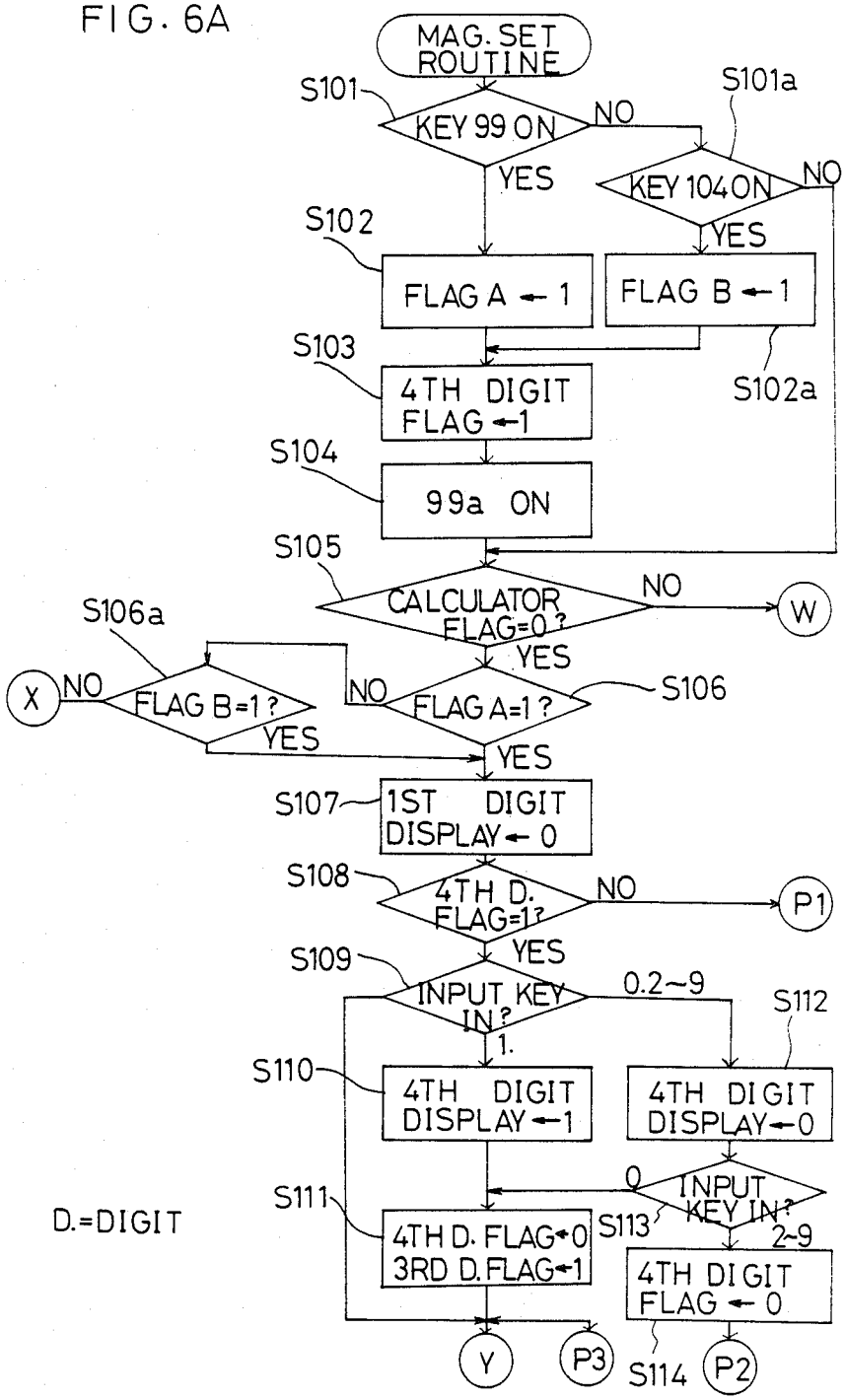
Figure 6B:
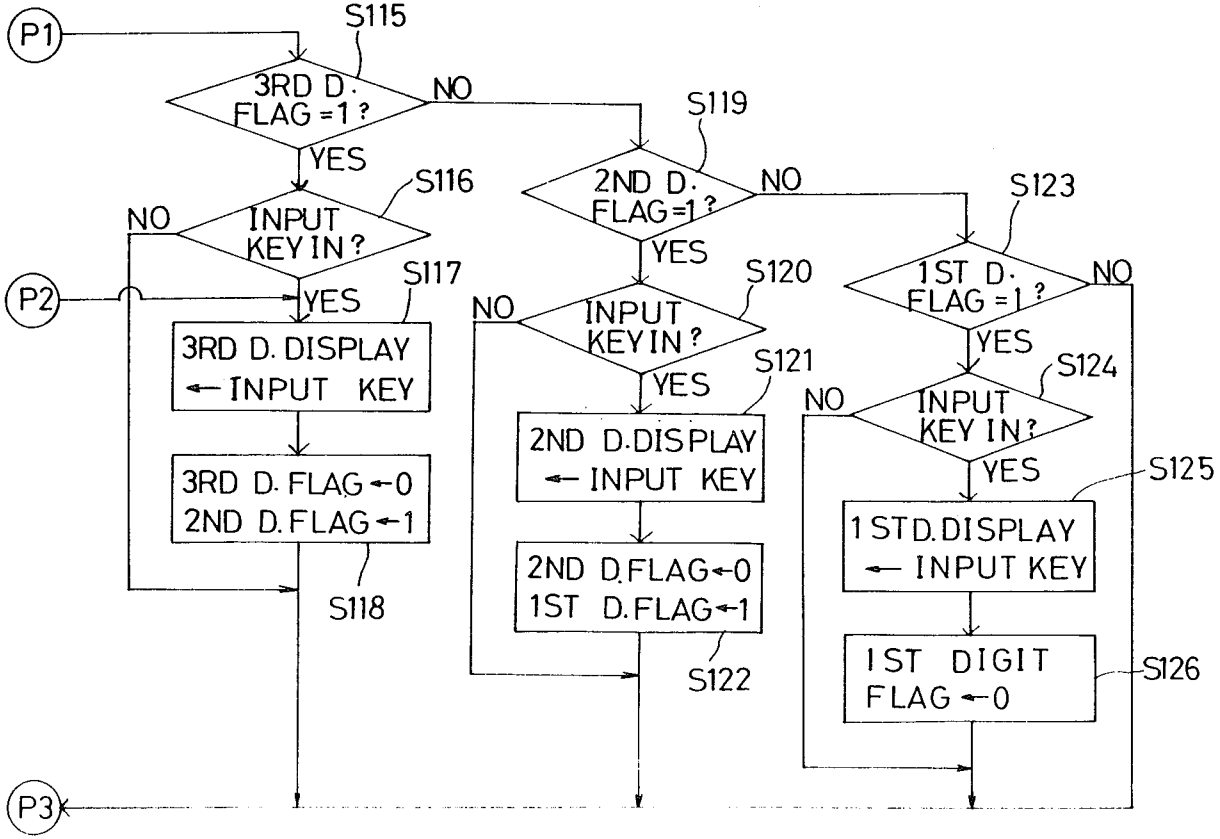

Referring particularly to FIGS. 6A and 6B, at steps S101, S101*a*, if the control mode is switched through the key 99 or 104 to the copy magnification mode, it is judged for which group of switches 100 through 103 or 95 through 98 the magnification setting is presently demanded. If the key 99 has been operated, the control mode is now in the first copy magnification setting mode and a flag 'A' is set to "1" at step S102. On the other hand, if the key 104 has been operated, the control mode is now in the second copy magnification setting mode and a flag 'B' is set to "1" at step S102*a*.

After a fourth digit flag (to be more particularly described later) is set to '1' at step S103, a display lamp 99*a* for displaying the magnification setting mode (for both the first and second magnification setting modes) is illuminated at step S104, and then if a calculator flag (to be more particularly described later) is set to '0', the process goes on to step S106. On the other hand, if the calculator flag is set to '1', i.e. the control mode is now in the calculator mode, the process jumps at step S105 to S220 (shown in FIG. 7B) to execute operations after this step S220, storing calculated results (upper and lower limit adjusted results) in a memory area corresponding to the operated key(s).

Then, provided that the control mode is now in the magnification setting mode at step S106 or S106*a*, the display of the first digit value is set to '0' at step S107. That is to say, if the copier control mode is switched to the magnification setting mode, the number display device 72 displays "bbb0"('b' denotes a blank), the device 72 becomes ready for receiving numerical value inputs from its fourth digit section.

The flags shown in steps S108, S115, S119, S123 are adapted for judging an input-waiting condition for the fourth digit (thousand digit), the third digit (hundred digit), the second digit (ten digit) and for the first digit (unit digit), respectively.

If any of the ten keys 80 through 89 is (are) operated under the input-waiting condition for the fourth digit, it is judged at step S109 which key(s) has (have) been operated.

If it is judged that the operated key comprises the key 80 corresponding to the numerical value '1', the process goes on to step S110 to display the value '1' at the fourth digit section. Then, the fourth digit flag is reset and the third digit flag is set at step S111 to be ready for receiving a third digit input. That is to say, if the '1' key 80 is operated at first, it is judged that the value '1' is set as the fourth digit value. In this specification, it is to be noted, the digit values are referred to in terms of the fourth, third, second and first digit in connection with the number display device 72. However, the numerical values representing magnifications actually comprise values of three decimal places and a significant figure of four digits.

At the aforementioned step S109, if the input numerical value comprises '0' or any one of '2' through '9', the process goes on to step S112 to display '0' at the fourth digit section of the device 72. That is to say, it is judged that the value '0' has been input as the fourth digit value. This is because, as described hereinbefore, the setting limit of the magnification is from 0.647 to 1.414 and thus the fourth digit value is necessarily either '0' or '1'.

At step S113, it is judged which of '0' or '2' through '9' the input value comprises, and if the input value is judged to be '0', the process goes on to step S111.

On the other hand, if the same input value is judged to be any one of '2' through '9' at this step S113, the fourth-digit flag is reset at step S114 and then the process goes on to step S117 to display the input value at the third digit section. That is to say, if any one numerical value of '2' through '9' has been input at first, it is judged that the input value comprises the third-digit value, whereby the key operation for inputting '0' at the fourth digit section may be skipped over.

At steps S115 through S126, operations are carried out for succesively displaying the input value at the digit sections (the third to the first section) corresponding to the flags. These operations are principally the same as the input operation for the fourth digit section and therefore will not be discussed.

In FIGS. 7A and 7B, there is shown a flow chart in which operations are executed for storing the above input and displayed numerical value at the memory area corresponding to a select key to be operated next.

In this flow, at step S201, it is judged whether the control mode is the first magnification setting mode or the second magnification setting mode. The operation at this step S201 is executed only when the either of the flag 'A' or the flag 'B' is set to '1'; therefore, only the state of flag 'A' is judged.

If it is judged at this step S201 that the flag 'A' is set to '1', the process goes on to steps after S220 for judging operations of the first group of select keys 95 through 98.

On the other hand, if it is judge that the flag 'A' is not set to '1' i.e. the flag 'B' is set to '1', the process goes on the steps after S202 for judging operations of the second group of select keys 100 through 103.

Firstly, operations at steps S202 through S205, which are executed when the select key 100 has been operated, will be described. In a subroutine (to be more particularly described later) at step S203, the upper or the lower limit adjustment is carried out if necessary. At step 204, the displayed numerical value is stored as the magnification data at the memory area Q1. Then, the flag 'B' is reset to release the magnification setting mode at step S205 and then the display lamp **99*a* is turned 'OFF' at step S207**.

At steps S211 through S213, S214 through S216, S217 through S219, S220 through S222, S227 through S229 and steps S233 through S235, same operations are carried out by corresponding the keys 101, 102, 103, 95, 96, 97 and 98 to the memory areas Q2, Q3, Q4, Q5, Q6, Q7 and Q8 respectively. In the above operations, it is to be noted, after the operations have been carried out for the first group of select keys 95 through 98, the calculator flag is reset at S224 and then its display lamp is turned 'OFF' at step S226. This is because the operations after step S220 are carried out also in the calculator mode to be particularly described later.

After the adjusted and displayed numerical data are stored in the memory areas corresponding to the operated keys, these data are transferred to the second CPU 202 at steps S206 and S223, by which second CPU 202 the magnification setting mechanism is controllably driven.

If the clear-stop key 91 is operated at step S208, a numerical value '1' is displayed at the first digit section as showing the number of copy at step S209 and the the magnification setting mode is released at step S210.

In FIG. 8, there is particularly shown the flow executed at step S203 shown in FIG. 7A.

In the operations shown in FIGS. 7A and 7B, if it is judged at step S240 that the displayed value is below 0.647, the value is adjusted to 0.647 at step S241. On the other hand, if it is judged at said step S242 that the displayed value exceeds 1.414, the value is adjusted to 1.414 at step S243, whereby the upper or the lower limit adjustment is carried out.

Figure 9:
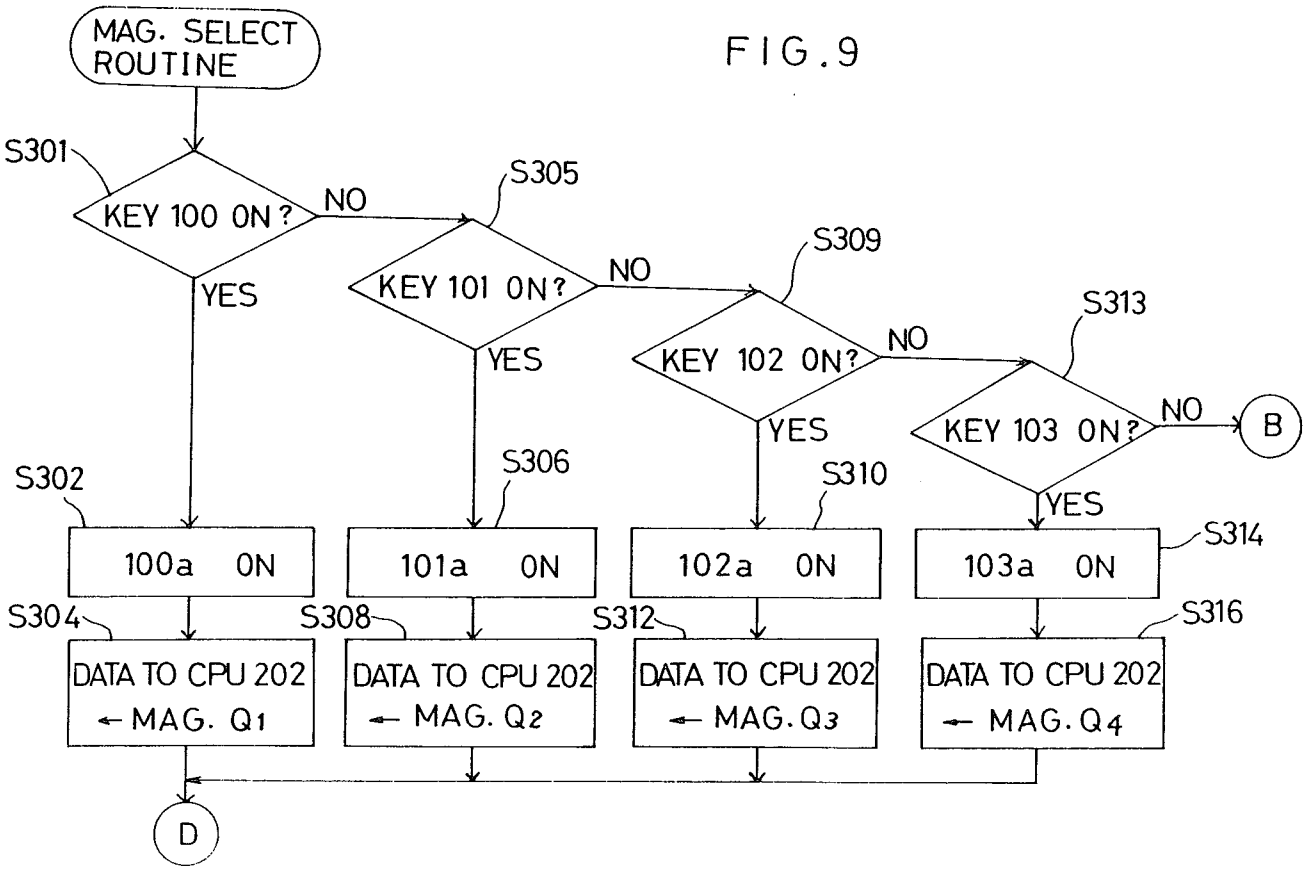
Figure 10:
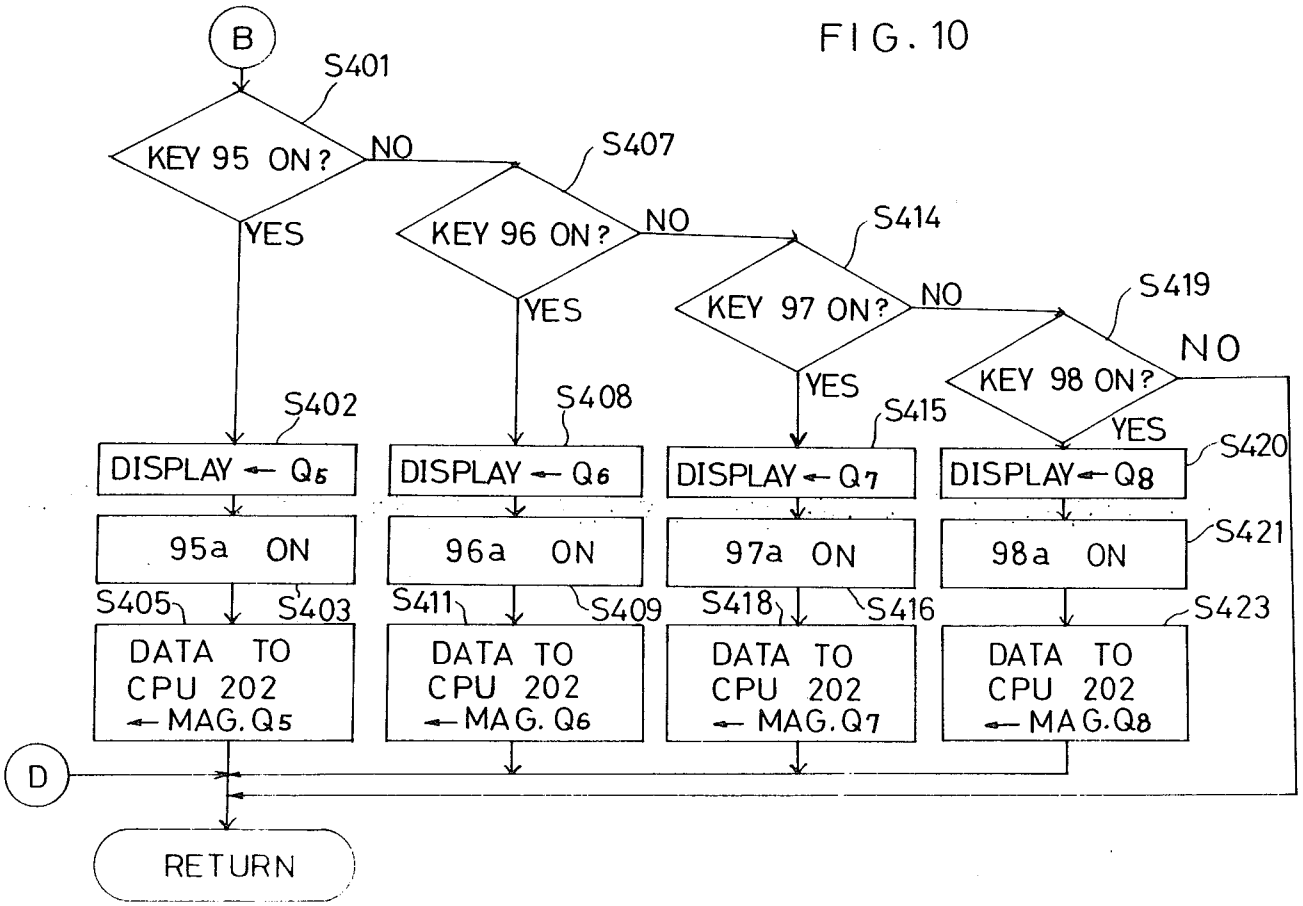

FIGS. 9 and 10 show flows executed when the second group of select keys 100 through 103 and when the first group of select keys 95 through 98, respectively.

Referring to the flow in FIG. 9, if any one of the select keys 100, 101, 102, 103 is operated, one of light emitting diodes **100*a*, 101*a*, 102*a*, 103*a* corresponding to the operated select key is illuminated and then the numerical data stored in the corresponding memory area are transferred to the second CPU 202, whereby the CPU 202** controllably drives the magnification setting mechanism.

Referring now to the flow in FIG. 10, in the same manner described in connection with the flow in FIG. 9, if any one of the first group of select keys 95 through 98 is operated, the corresponding light emitting diode is illuminated, and at the same time, since this is the manual magnification setting mode, the numerical value which is the magnification data present at the corresponding memory area, one of the memory areas Q5 through Q8, is displayed on the display device 72 at step S402, or S408, or S415, or S420. This display operation is carried out only while the respective key is being depressed, and when the key is released, the display device 72 calls and displays a number of copy preset at another memory device. Also, the numerical value stored in the memory areas Q5 through Q8 are transferred to the second CPU 202 at steps S405, S411, S418, S423, whereby the second CPU 202, based on the transferred data, controllably drives the magnification setting mechanism.

Figure 11A:
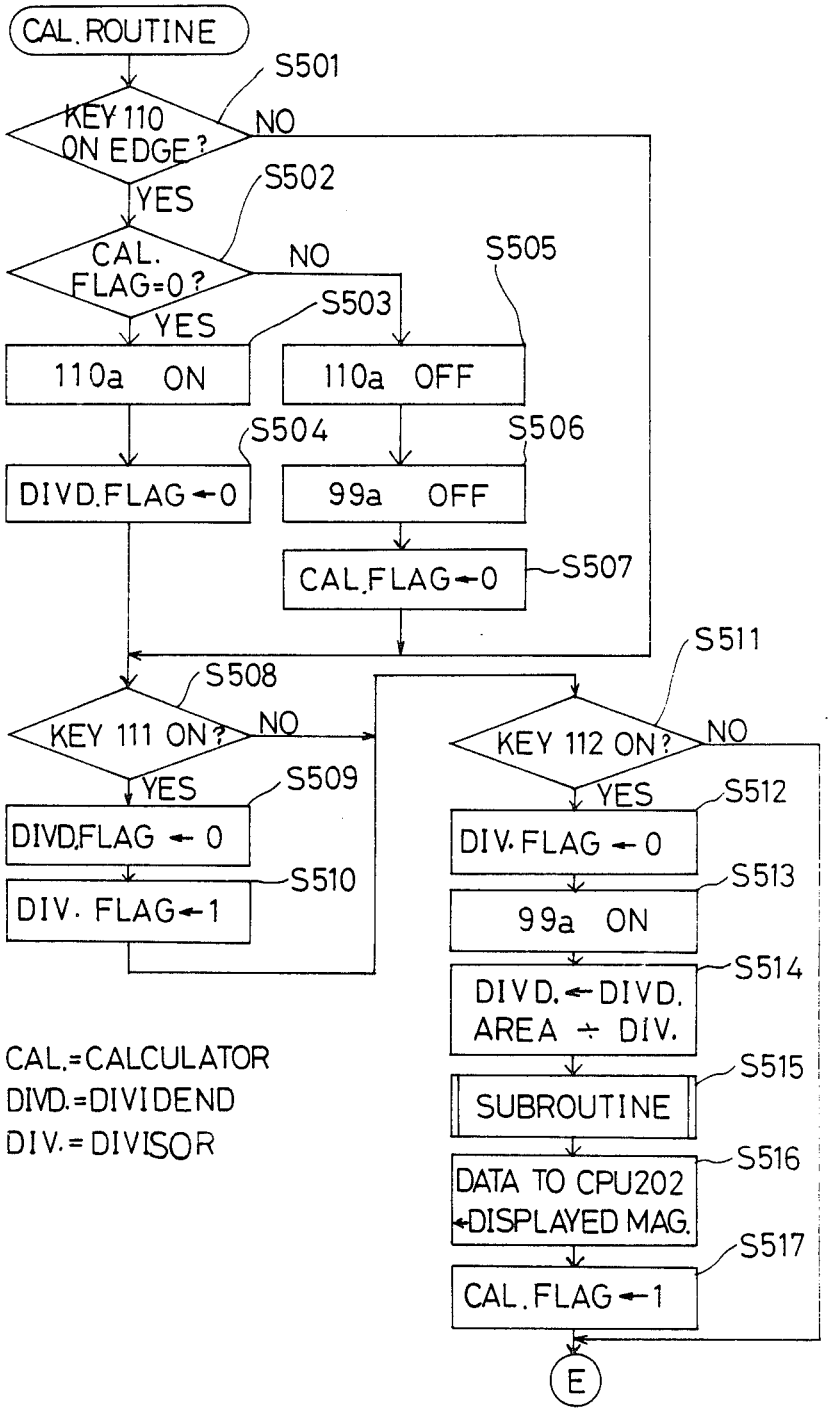
Figure 11B:
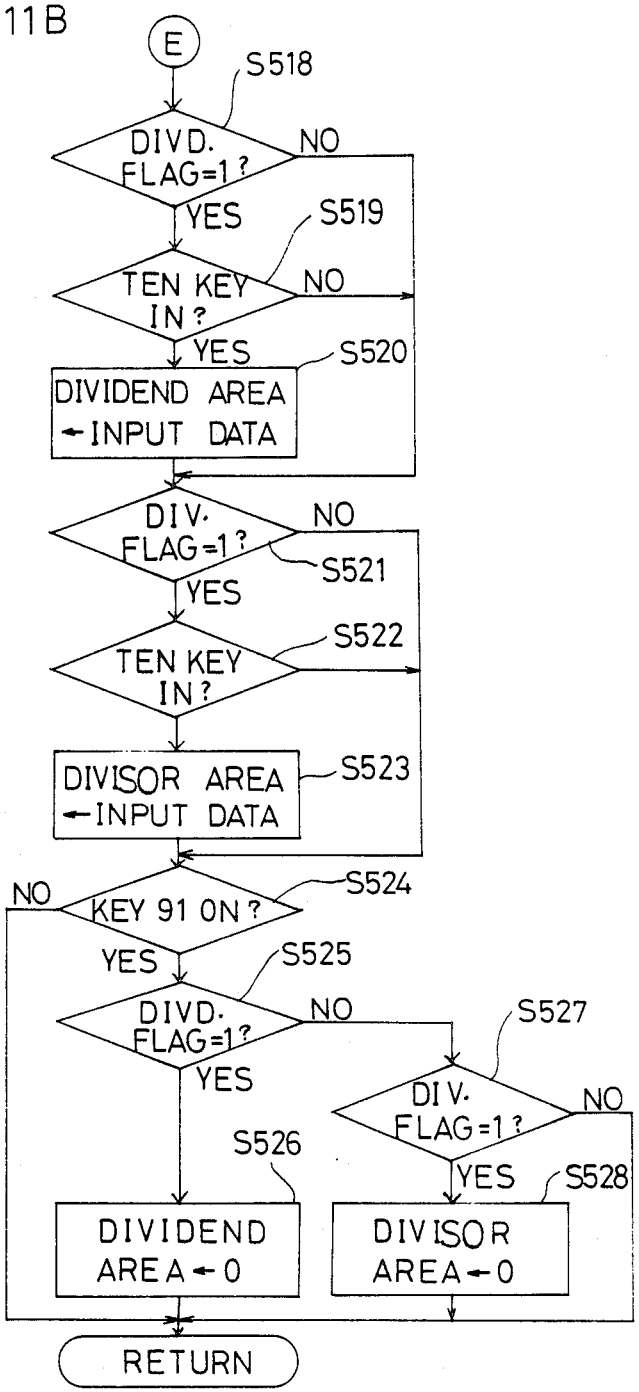

FIGS. 11A and 11B are a flow chart showing operations for calculating copy magnifications.

In this flow, firstly, the calculator mode is set or released in response to a detection of on-edge condition of the key 110 at step S501.

More particularly, if the calculator flag was previously set to '0', the calculator mode is set and illuminates the display light **110*a* at step 8503 and the dividend flag is set to '1' at step S504**, whereby the condition is set for receiving input of copy paper size.

On the other hand, if the calculator flag was previously set to '1', the display lamp **110*a* is turned 'OFF' at step S505 and the magnification setting mode display 99*a* is also turned 'OFF' at step S506 and the calculator flag is reset at S507, whereby the calculator mode is released. The operations at the above steps S505 through S507** are executed for releasing the calculator mode when the calculation was carried out but it is not desired to store the calculated result in the magnification setting keys.

Thereafter, in response to a detection of on-edge state of the divisor key 111 at step S508, the dividend flag is set to '0' at step S509 and the divisor flag is set to '1' at step S510, whereby a condition is set for receiving an input of document size.

In response to a detection of on-edge state of the equal key 112 at step S511, the divisor flag is reset at step S512 and the magnification setting mode display 99*a* is illuminated at step S513 and a division is carried out at step S514. Then, based on the division result, the subroutine operations shown in FIG. 8 are carried out for making the upper and lower limit adjustment and then the adjusted data are transferred to the second CPU202 at step S516, whereby the second CPU controllably drives the magnification setting mechanism to enable a copying operation at the calculated magnification. Then, the calculator flag is set to '1' at step S517, whereby the process goes from the step S105 in FIG. 6A to the step S220 in FIG. 7B and a magnification setting is enabled in the same manner as in the manual magnification setting mode.

Nextly, provided that the dividend flag is set to '1' at step S518, the data input by means of the ten keys 80 through 89 are stored in the memory areas reserved for dividends at steps S519, S520.

Provided the divisor flag is set to '1' at step S521, the data input by means of the ten keys 80 through 89 are stored in the memory areas reserved for the divisors at steps S522 and S523.

If it is judged that the dividend flag is set to '1' in response to a detection of on-edge state of the clear-stop key 91, the data stored in the memory areas for dividends are cleared at step S526, or if it is judged that the divisor flag is set to '1', the the data stored in the memory areas for divisors are cleared at step S528.

In the above-described way, the calculation and setting of copy magnification, the display of the calculated result and the data transfer to the second CPU are carried out. It is to be again noted here that the second CPU 202 controllably drives the magnification setting mechanism based on the data transferred thereto.

As can be seen clearly from the above description, according to the copier related to the present invention, it is readily possible to set a desired copy magnification by using the first magnification setting mode. Also, by using the second magnification setting mode, it is possible to adjust the preset copy magnifications.

Furthermore, when the copy paper size and the document size are obtained by calculations, the calculated results are not only displayed but also transferred to the second CPU 202, it is possible for this CPU 202 to immediately drive the magnification setting mechanism. If the calculated result does not exist within the predetermined copy magnification range, the above display operation is carried out after making the upper and lower limit adjustment.

Figure 12A:
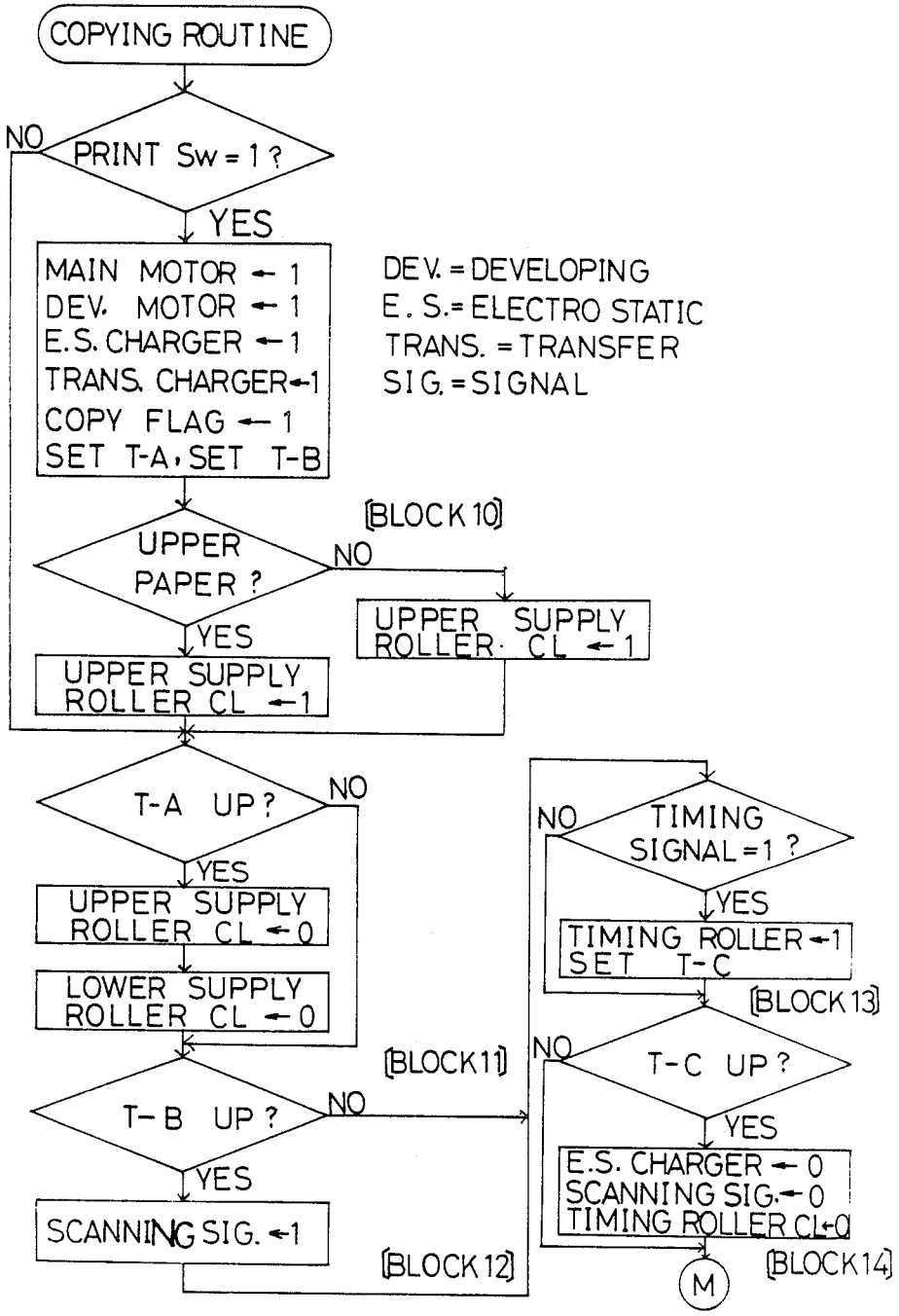
Figure 12B:
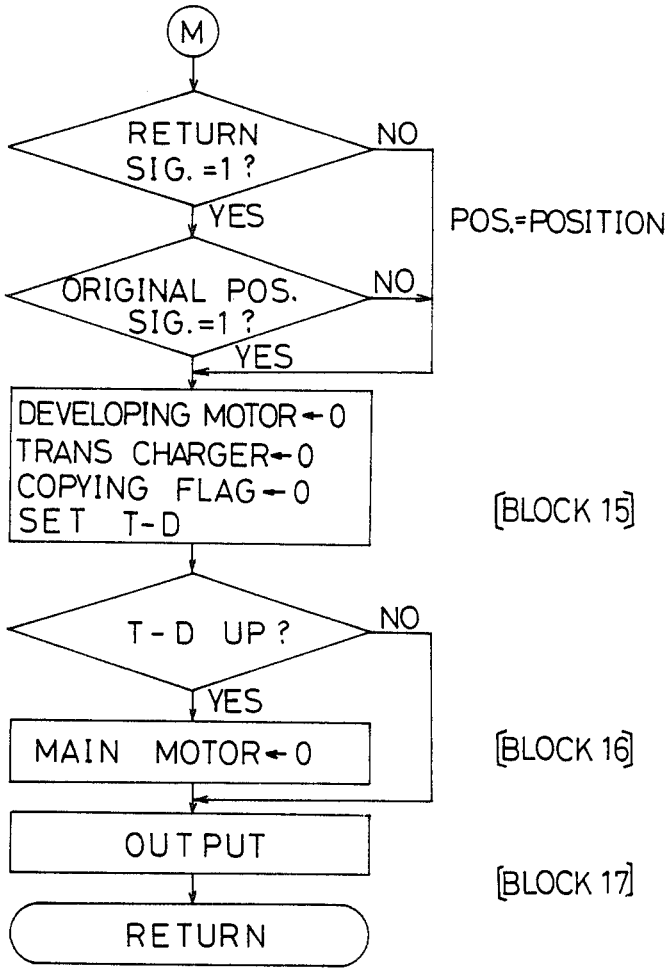
Figure 13:
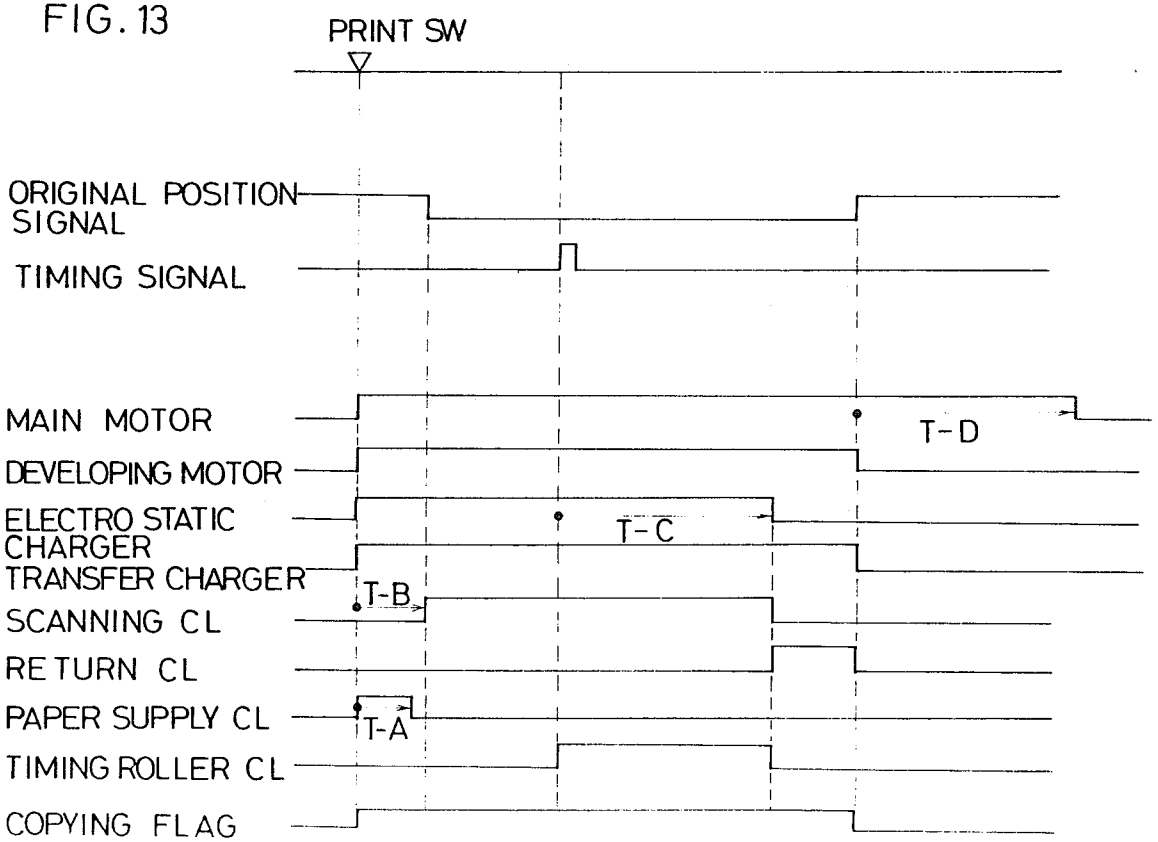
FIG. 13 is a timing chart of operations shown in FIG. 12.

In FIGS. 12A and 12B, there is shown a typical flow for controlling the copy operations of the copier related to the present invention. This flow will be briefly described in connection with a timing chart shown in FIG. 13.

At a block 10, in response to an operation of a print-start key, the main motor M1, the developing motor M2, the electro static charger 12, the transfer charger 14 are respectively activated, and at the same time a copy flag adapted for indicating on-going copy operation is set to '1', control timers T-A, T-B are started and the clutch of the selected paper suppler roller is engaged.

At a block 11, in response to a detectionof a timing-up of the timer T-A, the paper supply clutch is disengaged.

At a block 12, in response to a detection of a timing-up of the timer T-B, the scanning motor M3 is activated to start an image scanning operation.

At a block 13, in response to an output of a timing signal in the course of the scanning operation, a timing roller clutch CL3 is engaged and at the same time a timer T-C is se, whereby a copy paper is conveyed synchronously with an image of the photosensitive drum 10 by means of the timing roller 35.

At a block 14, in response to a detection of timing-up of the timer T-C, the electro static charger, the scanning motor and the timing roller clutch are respectively disactivated. It is to be noted that the timer T-C may be modified to be freely adaptable for different sizes of the copy paper to be used.

At a block 15, when with a return movement of the copier the optical unit is returned to its original position and the original position switch is activated, the developing motor M2, the transfer charger 14 are respectively disactivated, the copy flag is set to '0' and at the same time a timer T-D is set.

At a block 16, in response to a detection of timing-up of the timer T-D, the main motor M1 is disactivated. At a block 17, various output operations are carried out.

The timers T-A through T-D described in the above flow charts and the timing chart comprise digital timers so programmed as to be incremented up to be '1' in a routine executed within a time period regulated by an integrated timer and the timing-up periods are stored in these timers as numerical value data.

In the above-described embodiment, the calculator mode key 110, the division key 111 and the equal key 112 are provided on the control panel separately from the other keys. However, in place of provision of these independent keys, other keys may be co-utilized by carrying out predetermined signal processing operations.

I claim:

1. A magnification-variable copier, comprising:

a magnification-varying mechanism;

input means for inputting selected numerical data to be calculated;

commanding means for commanding execution of calculation;

calculator means for executing the calculation of the input data in response to a signal from said commanding means;

means adapted for judging whether or not a calculated result belongs in a predetermined settable magnification range and adapted also for adjusting the calculated result either to an upper limit or to a lower limit of said range whichever is closer thereto when the calculated result is out of the predetermined settable magnification range;

control means for controllably activating said magnification-varying mechanism using the regular or adjusted calculated result as a magnification to be set;

memory capable of storing the calculated result;

means for receiving a command to store the calculated result into said memory; and means for permitting a start of copying whether or not the calculated result is stored in said memory.

2. A magnification-variable copier, as defined in claim 1, wherein said data input means includes ten keys for inputting a divisor value and a dividend value.

3. A magnification-variable copier, as defined in claim 2, wherein said data input means further includes an input key for delimiting between a divisor value input and a dividend value input.

4. A magnification-variable copier, as defined in claim 1, further comprising display means for displaying the regular or adjusted calculated result.

5. A magnification-variable copier, as defined in claim 1, wherein said control means, when the calculated result is stored in said memory and said storing-command receiving mans is activated, reads out the calculated result stored in said memory and activates said magnification-varying mechanism using said read-out result as a magnification to be set.

* * * * *